US006786751B2

(12) United States Patent
Maeda et al.

(10) Patent No.: US 6,786,751 B2
(45) Date of Patent: Sep. 7, 2004

(54) COMBINED TERMINAL FITTING

(75) Inventors: Tatsuya Maeda, Yokkaichi (JP); Masahide Hio, Yokkaichi (JP); Atsushi Nishida, Toyota (JP); Masato Minakata, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/628,215

(22) Filed: Jul. 28, 2003

(65) Prior Publication Data

US 2004/0023542 A1 Feb. 5, 2004

(30) Foreign Application Priority Data

Jul. 29, 2002 (JP) ..... 2002-220170

(51) Int. Cl.[7] ..... H01R 11/12
(52) U.S. Cl. ..... 439/287; 439/883
(58) Field of Search ..... 439/287, 883, 439/907, 288; 174/84 C

(56) References Cited

U.S. PATENT DOCUMENTS 2,713,154 A 7/1955 Bilsborough
5,759,055 A 6/1998 Colantuano et al.
6,530,795 B2 3/2003 Maeda et al.

FOREIGN PATENT DOCUMENTS

| | | |
|---|---|---|
| EP | 0 803 935 A2 | 10/1997 |
| FR | 2 220 887 | 10/1974 |
| JP | 11-67305 | 7/1989 |

*Primary Examiner*—Alex Gilman
(74) *Attorney, Agent, or Firm*—Gerald E. Hespos; Anthony J. Casella

(57) ABSTRACT

A combined terminal fitting assembly is provided to fix ends of three or more wires to one fixing place. Engaging portions (25, 26, 34, 35) for holding a right terminal fitting (TR) and a left terminal fitting (TL) assembled are provided on both upper and lower surfaces of terminal main bodies. Thus, the right terminal fittings (TR) and the left terminal fittings (TL) can be placed alternately one over another. As a result three or more wires (W) can be fixed to one fixing place. Upon assembling, the wire (W) of the right terminal fitting (TR) and the wire (W) of the left terminal fitting (TL) are brought gradually closer to each other from most distant positions. Thus, the left and right wires (W) neither overlap nor interfere with each other.

9 Claims, 13 Drawing Sheets

COMBINED TERMINAL FITTING

BACKGROUND OF THE INVENTION

1. Field of the Invention

The invention relates to a combined terminal fitting assembly.

2. Description of the Related Art

U.S. Pat. No. 6,530,795 and FIGS. 14 and 15 herein show a combined terminal fitting assembly. With reference to FIGS. 14 and 15, the combined terminal fitting assembly has a pair of terminal fittings 100, 101. Each terminal fitting 100, 101 includes a wire connecting portion 102 to be crimped into connection with an end of a wire W and a shaft fixing portion 104 formed with an insertion hole 103 through which an unillustrated bolt is insertable. Engaging portions 105, 106 are formed on each shaft fixing portion 104 at opposite sides of the insertion hole 103. The engaging portions 105, 106 of one shaft fixing portion are engageable with those 106, 105 of the other shaft fixing portion 104. The terminal fittings 100, 101 are assembled by inserting the engaging portions 105 into the insertion holes 103 of the mating terminal fitting 100, 101 and then sliding the shaft fixing portions 104 relative to one another to align the insertion holes 103. Then, the engaging portions 105, 106 are engaged to assemble the terminal fittings 100, 101 with the insertion holes 103 aligned along thickness direction as shown in FIG. 15.

The two assembled terminal fittings 100, 101 can be mounted at one place by one bolt.

However, the combined terminal fittings 100, 101 can fix the ends of at most two wires W at one place. Thus, at least two or more fixing places must be provided to fix the ends of three or more wires W.

The invention was developed in view of the above problem and to enable ends of a plurality of wires to be fixed at one fixing place.

SUMMARY OF THE INVENTION

The invention relates to a combined terminal fitting assembly with first and second terminal fittings. The first terminal fitting has a first main body and a first wire connecting portion that enables a wire to extend from a position near a first side of the first main body. The second terminal fitting has a second main body and a second wire connecting portion that enables a second wire to extend from a position near a second side of the second main body. The terminal fittings can be assembled so that the main bodies are substantially one over the other and so that the wires are substantially parallel at the lateral sides. The terminal fittings have engaging means at both surfaces of the terminal main bodies. The first terminal fitting can be slid transversely with respect to the second terminal fitting so that the engaging means engage to hold the terminal fittings assembled.

The first terminal fitting preferably is a right terminal fitting and the first wire connecting portion enables a wire to extend back from a right-side position of the first main body. The second terminal fitting preferably is a left terminal fitting and the second wire connecting portion enables the second wire to extend back from a left-side position of the second main body. The right and left terminal fittings preferably are assembled so that the main bodies are placed one over the other and so that the wires are parallel at the right and left sides. The engaging means are provided at both the upper and lower surfaces of the main bodies and engage each other by sliding the right terminal fitting leftward with respect to the left terminal fitting for holding the terminal fittings assembled. Thus, three or more, wires can be fixed to one fixing place. Further, the wire connecting portions are parallel and arranged alternately at the left and right sides of the respective terminal fittings. Therefore, a space corresponding to the thickness of the left terminal fitting can be secured between the wires connected with the right terminal fittings, and interference of the right wire connecting portions and the right wires can be avoided.

The right terminal fitting has the wire connecting portion at the right-side and is slid leftward with respect to the left terminal fitting during assembly. Thus, the left and right wire connecting portions are at most distant positions at the start of a sliding movement. As the sliding movement progresses, the two wire connecting portions move closer to each other. However, the left and right wire connecting portions neither overlap nor interfere during assembly.

Each engaging means preferably has a slit extending along the transverse direction from an edge of the engaging means. One engaging means preferably fits into the slit of the mating engaging means during assembly to ensure a sufficient area of engagement between the engaging means. More particularly, each engaging means of the right terminal fitting preferably has a slit extending rightward from the left edge of the engaging means, and each engaging means of the left terminal fitting preferably has a slit extending leftward from the right edge of the engaging means. One engaging means fits into the slit of the mating engaging means during assembly to ensure a sufficient area of engagement between the engaging means.

The extending directions of the slits of the engaging means of the right and left terminal fittings are transversely opposite, and the left and right terminal fittings achieve a sufficient area of engagement. However, the slits of the same kinds of terminal fittings extend in the same direction. Thus, there is insufficient area of engagement for the engaging means, and the engaging means cannot engage. Accordingly, the terminal fittings cannot be assembled in a way that would cause the wires of adjacent terminal fittings to interfere.

The engaging means of each of the second and first terminal fittings projects from the upper and lower surface of the main body.

At least one single-face terminal fitting preferably is provided and has a wire that extends from a position displaced along the transverse direction of a substantially flat main body. The main body has an engaging means projecting from only one of the upper and lower surfaces of the main body.

The engaging means of the left and right terminal fittings project from both upper and lower surfaces of the main body. However, the engaging means of the single-face terminal fitting projects from only one of the upper and lower surfaces of the main body. The single-face terminal fitting is assembled with a terminal fitting at an end of a group of terminal fittings, and the engaging means of the single face terminal fitting faces toward the group. Thus, a surface of the single-face terminal fitting opposite from the engaging means thereof is brought into contact with a fixing surface, and the engaging means does not interfere with the fixing surface. Accordingly, the group of the terminal fittings and the single-face terminal fitting can be fixed stably to the fixing surface.

Each main body preferably comprises a plurality of plates folded from one conductive plate, and the engaging means are formed on the plates at the upper and lower surfaces.

The invention also relates to a method of assembling a combined terminal fitting assembly. The method includes providing a first terminal fitting having a wire connecting portion for enabling a wire to extend at a first-side of a main body and providing a second terminal fitting having a wire connecting portion for enabling a wire to extend at a second-side position of a main body. The method continues by placing the main bodies over one another with the wires substantially parallel at the lateral sides. The method then includes sliding the first terminal fitting along a transverse direction with respect to the second terminal fitting so that engaging means at the opposed surfaces of the main bodies hold the second and first terminal fittings assembled.

The method may further comprise a step of forming each engaging means with a slit extending along the transverse direction from an edge of the engaging means. Thus, upon assembling the terminal fittings, one engaging means fits into the slit of the mating engaging means to ensure a sufficient area of engagement between the engaging means of both terminal fittings.

These and other objects, features and advantages of the invention will become more apparent upon reading the following description of preferred embodiments and accompanying drawings. It should be understood that separately described features may be combined to additional embodiments.

DETAILED DESCRIPTION OF THE PREFERRED EMBODIMENTS

Figure 1:
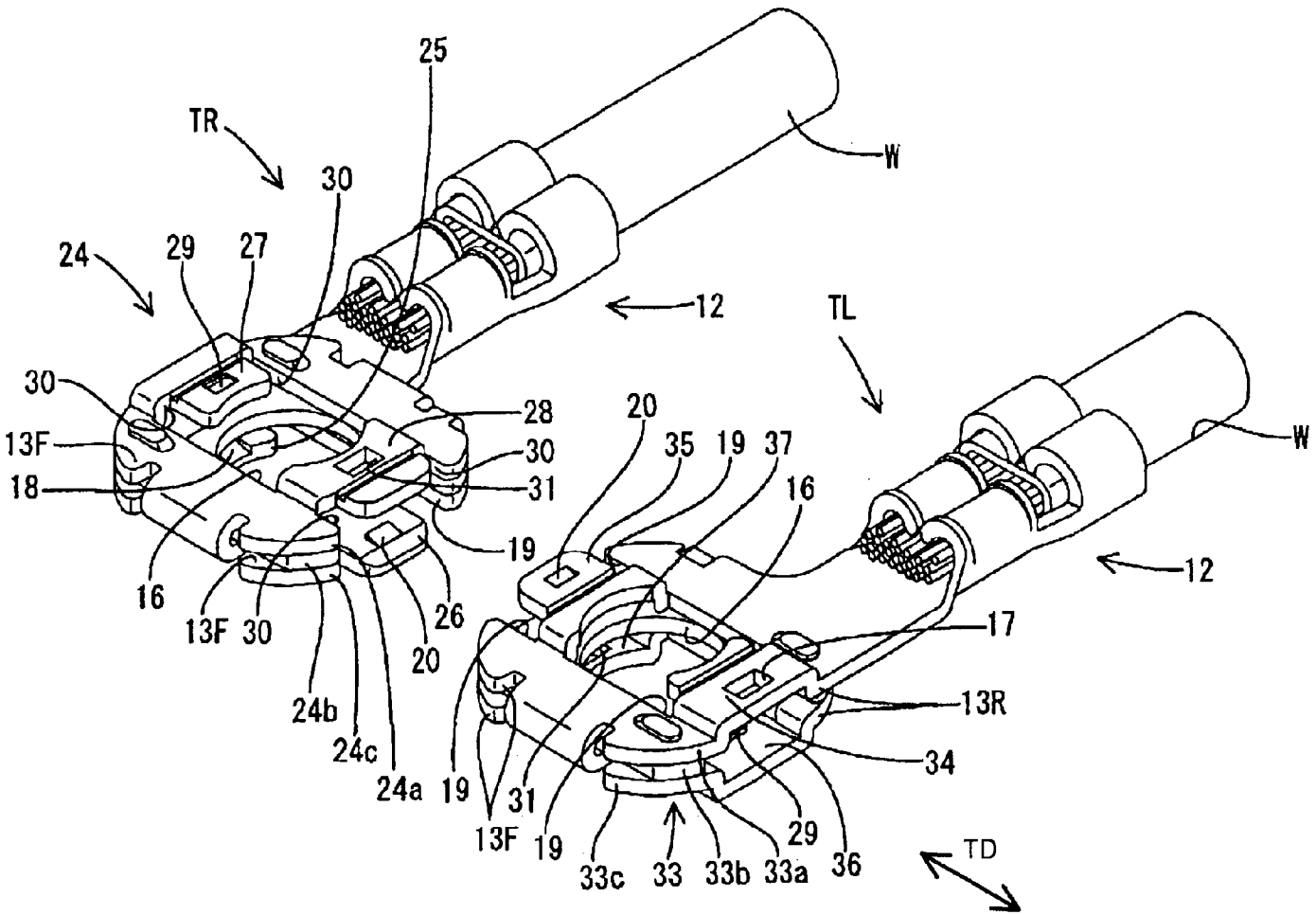
FIG. 1 is a perspective view showing a state before a right and a left terminal fittings of a first embodiment of the invention are assembled.
Figure 2:
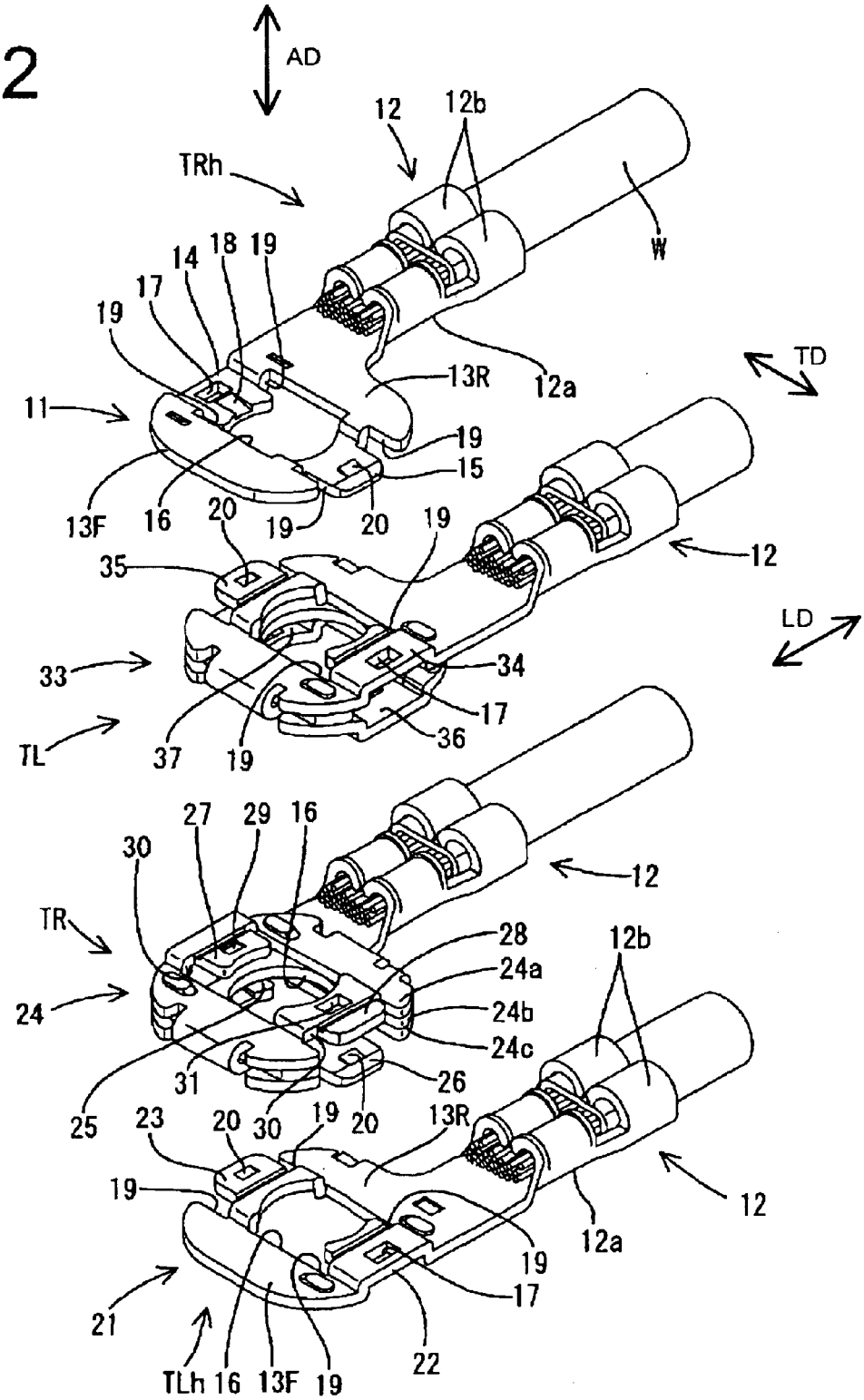
FIG. 2 is a perspective view showing a state before four terminal fillings are assembled.
Figure 3:
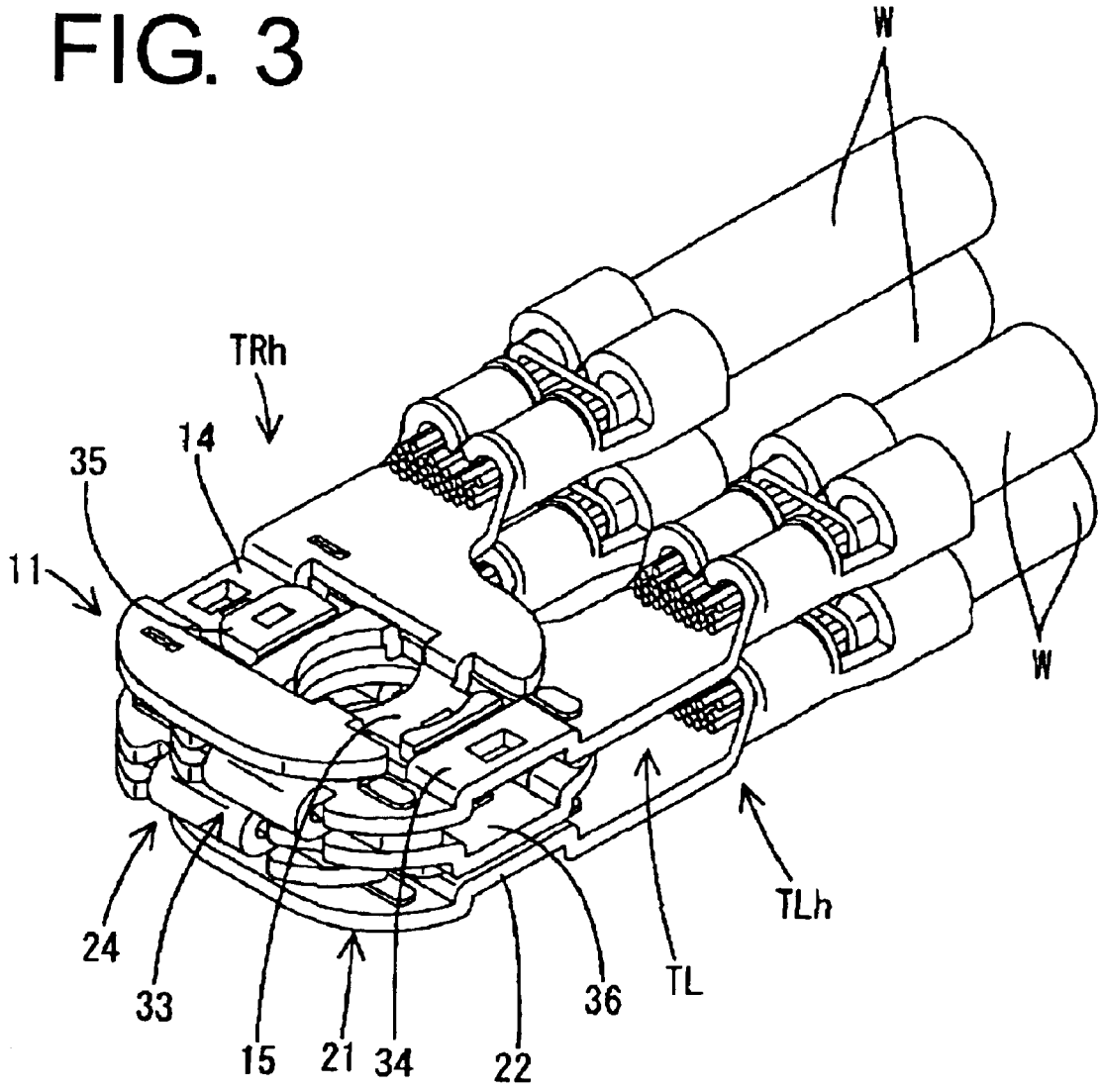
FIG. 3 is a perspective view showing an intermediate stage of assembling the four terminal fittings.
Figure 4:
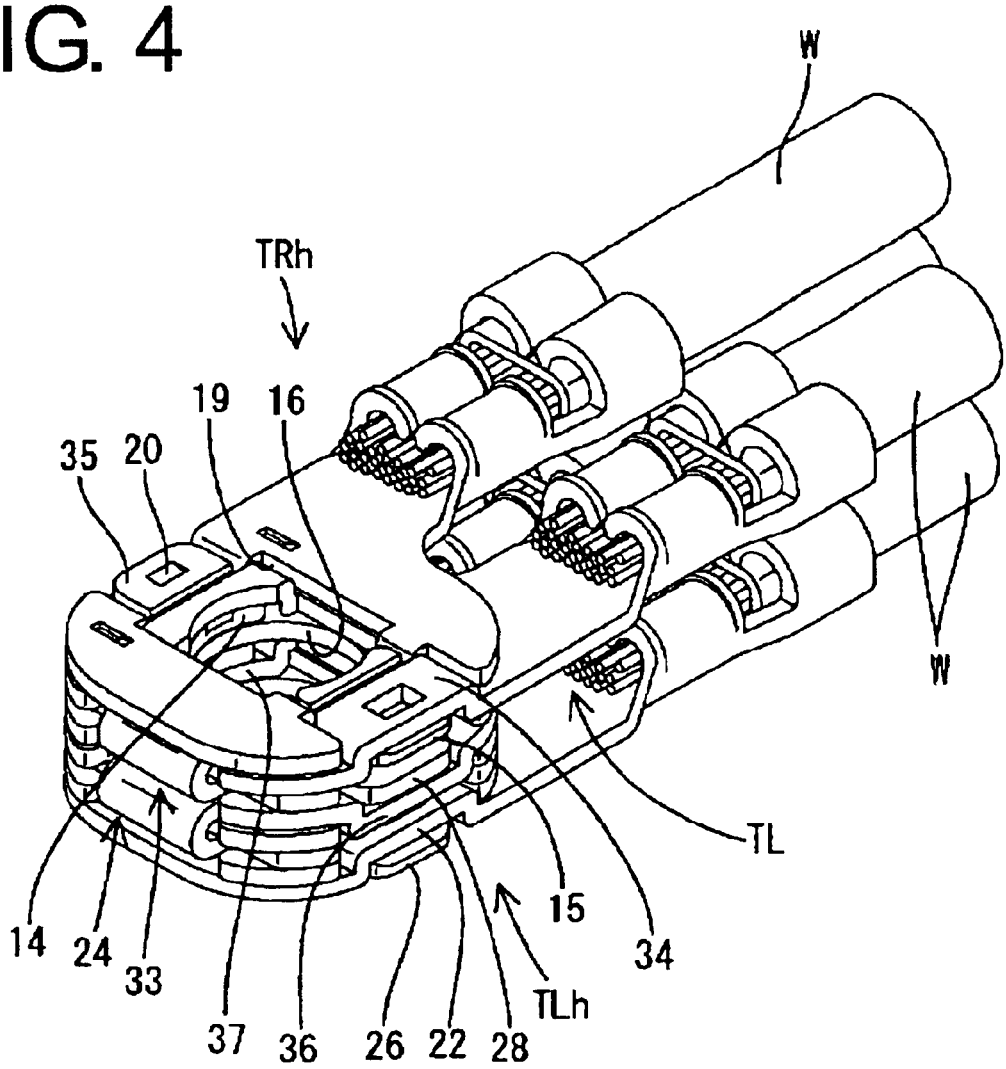
FIG. 4 is a perspective view showing a state where the assembling of the four terminal fittings is completed.
Figure 5:
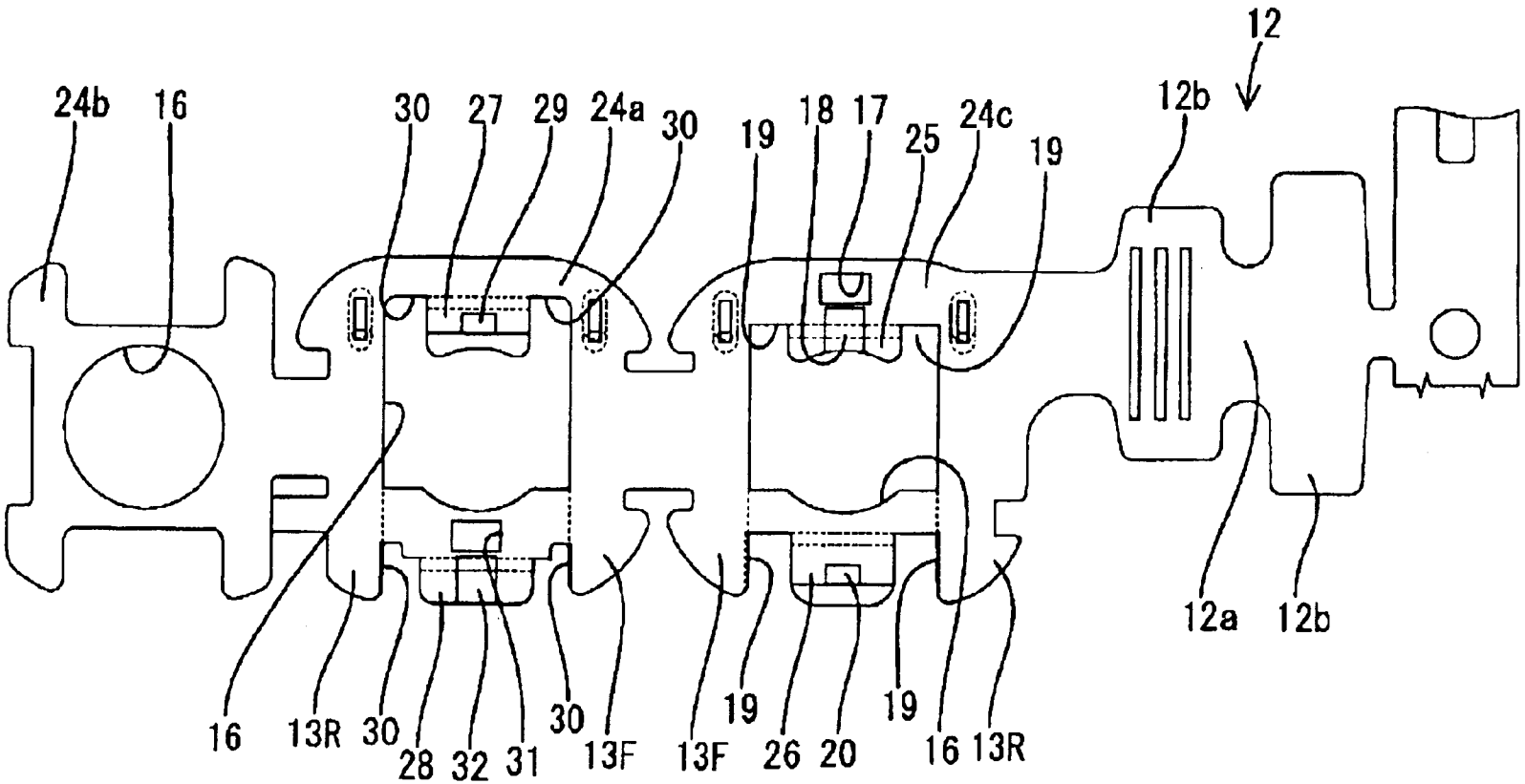
FIG. 5 is a development of the right terminal fitting.
Figure 6:
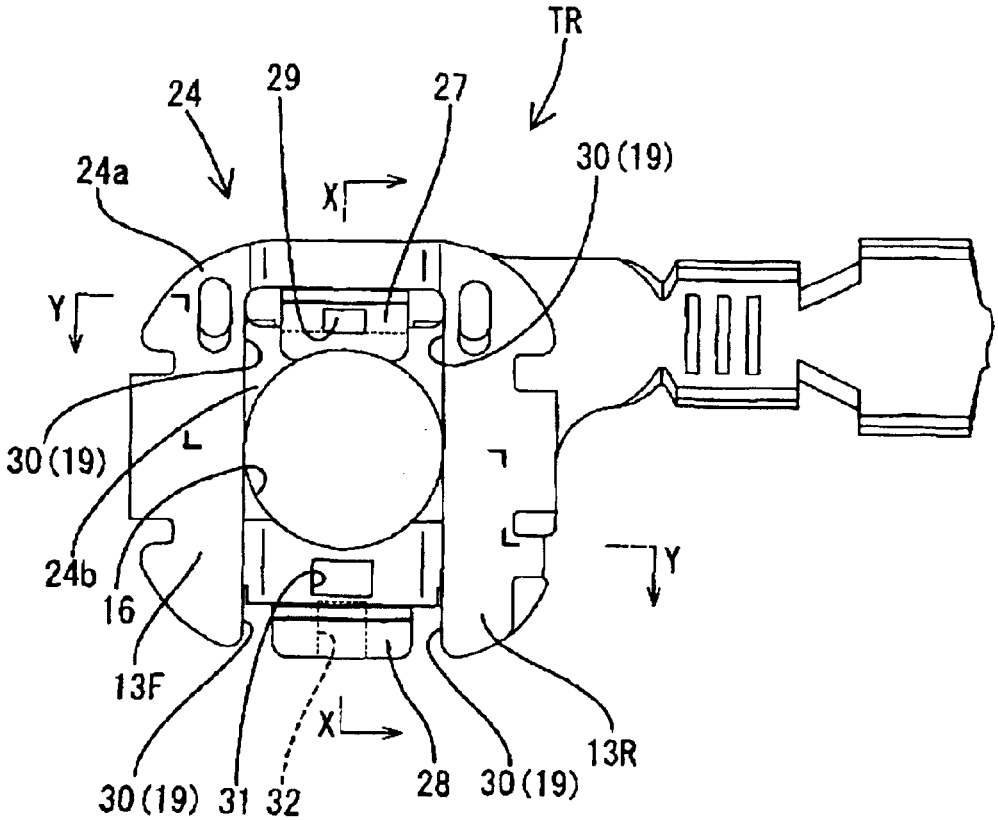
FIG. 6 is a plan view of the right terminal fitting.
Figure 7:
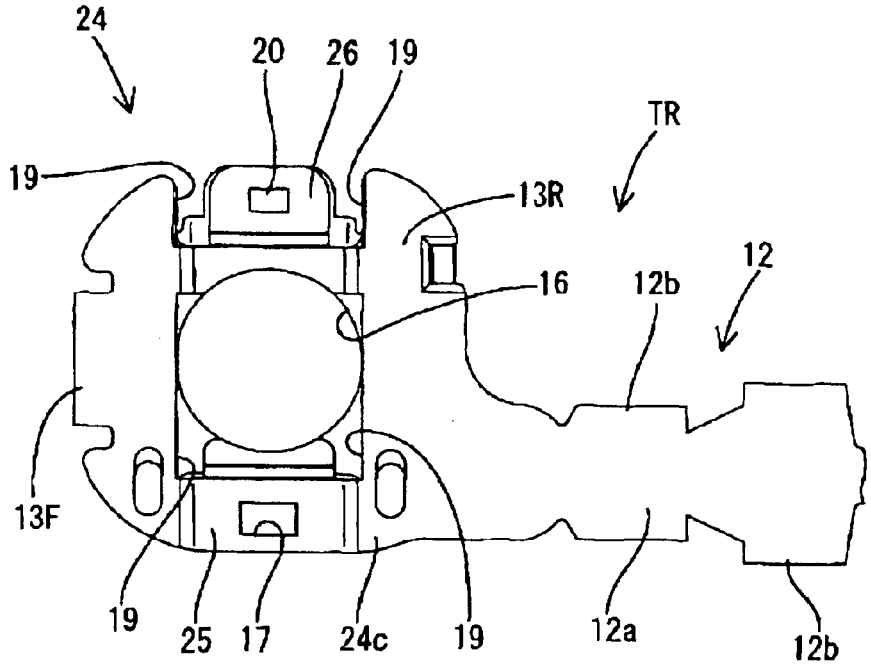
FIG. 7 is a bottom view of the right terminal fitting.
Figure 8:
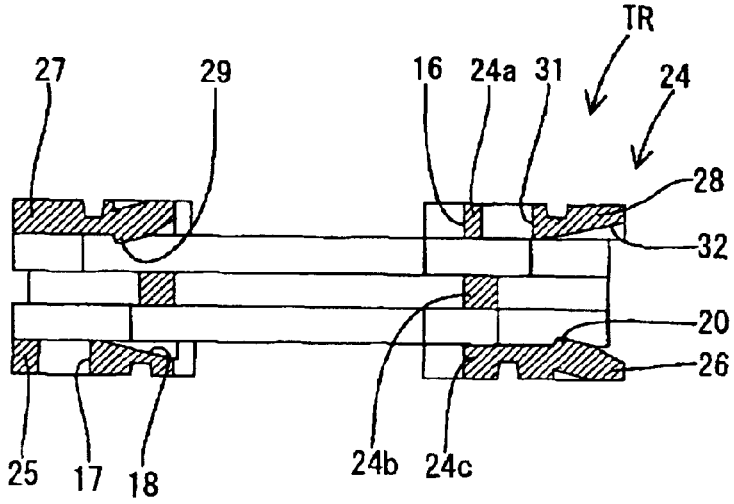
FIG. 8 is a section of the right terminal fitting along 8—8 of FIG. 6.
Figure 9:
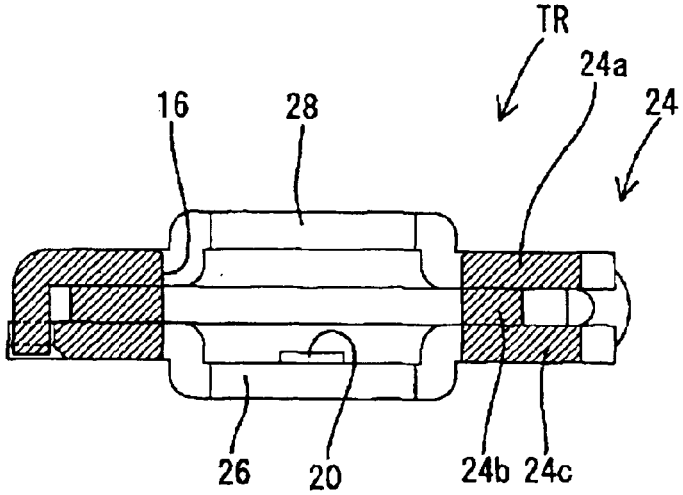
FIG. 9 is a section of the right terminal fitting along 9—9 of FIG. 6.
Figure 10:
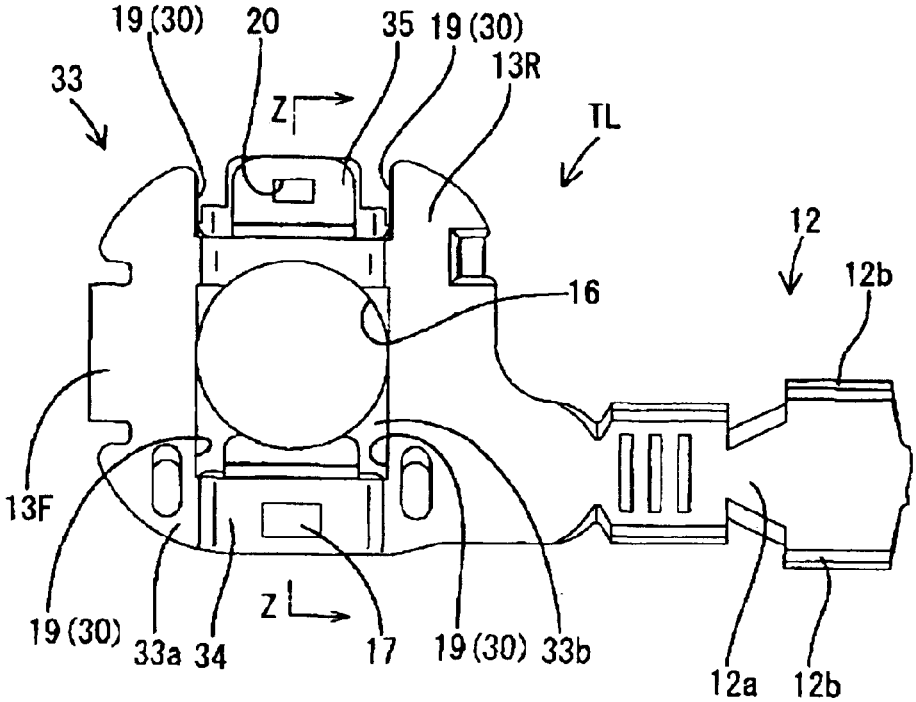
FIG. 10 is a plan view of the left terminal fitting.
Figure 11:
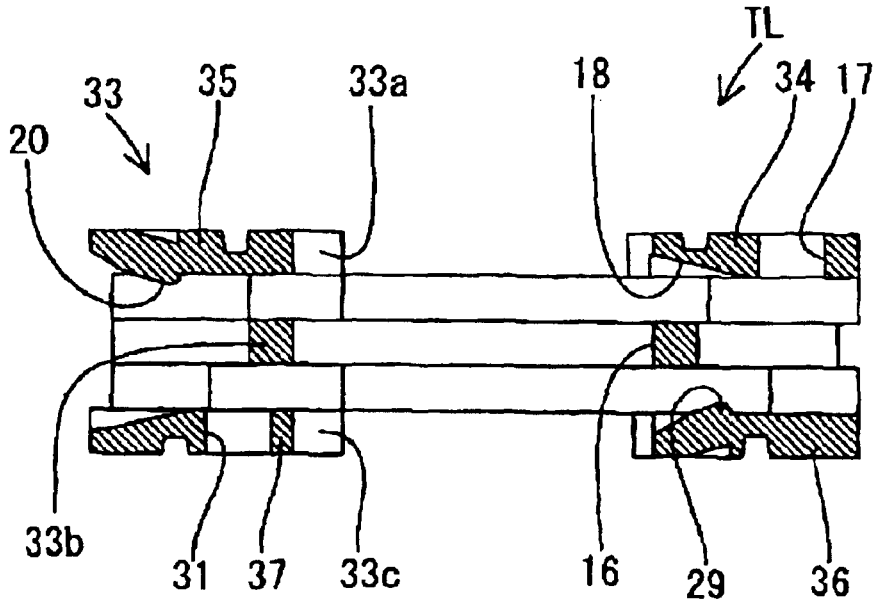
FIG. 11 is a section of the left terminal fitting along 11—11 of FIG. 10.

A combined terminal fitting assembly according to a first embodiment of the invention is illustrated in FIGS. 1 to 12. The combined terminal fitting assembly has a right single-face terminal fitting TRh, a left terminal fitting TL, a right terminal fitting TR and a left single-face terminal fitting TLh assembled one over the other in this order from the top. Each of the terminal fittings TRh, RL, TR, TLh is formed by bending, folding or embossing a conductive metallic plate stamped or cut into a specified shape. No repeated detailed description is given for elements that are the same or similar, but rather these same or similar elements merely are identified by the same reference numerals.

The right single-face terminal fitting TRh has a substantially square main body 11 with substantially arcuate corners. A wire connecting portion 12 extends back from the rear edge of the main body 11 and is disposed at a right side of the main body 11 along a transverse direction TD. In this regard, the transverse direction TD is substantially normal to the longitudinal direction LD of a wire W in a position near the wire connecting portion 12. The wire connecting portion 12 is an open barrel with a bottom plate 12*a* and crimping pieces 12*b* that extend up from the lateral edges of the bottom plate 12*a*. A wire W is connected with the wire connecting portion 12 by crimping, bending or folding the crimping pieces 12*b* so that the wire W extends back from the wire connecting side of the main body 11. The terminal main body 11 includes front and rear flat portions 13F, 13R that are long along the transverse direction TD. A first engaging portion 14 bridges the right ends of the flat portions 13F, 13R at the same side as the wire W with respect to transverse direction TD, and a second engaging portion 15 bridges the left ends of the flat portions 13F, 13R. A through hole 16 is formed in a substantially central portion surrounded by these elements for receiving a bolt. The rear flat portion 13R is substantially continuous with the wire connecting portion 12 and both flat portions 13F, 13R are located at the substantially same height.

The first and second substantially flat engaging portions 14, 15 are transversely spaced from one another and are located below the flat portions 13F, 13R by substantially the thickness of the flat portions 13F, 13R. It should be noted that a combination of these two engaging portions 14, 15 is called an A-type for the sake of convenience. A locking hole 17 is formed near the right side of the first engaging portion 14 and a slanted surface 18 slopes down on the upper surface of the first engaging portion 14 from the locking hole 17 to the left edge of the fist engaging portion 14. The first engaging portion 14 also has front and rear slits 19 that extend transversely to the right from the left edge substantially along the boundaries with the flat portions 13F, 13R. A locking projection 20 is embossed to project up near the left side of the second engaging portion 15 and slopes down to the left. The second engaging portion 15 has front and rear slits 19 that extend transversely to the right from the left edge substantially along the boundaries with the flat portions 13F, 13R. The slits 19 make a substantially left half of the second engaging portion 15 near the locking projection 20 slightly resiliently deformable up and down along an arrangement direction AD.

The left single-face terminal fitting TLh has a wire connecting portion 12 that extends back from the rear edge of a main body 21. The wire connecting portion 12 has a bottom plate 12*a* and crimping pieces 12*b* that extend up from the bottom plate 12*a*. Thus, a wire W can be connected with the wire connecting portion 12 by crimping, bending or folding the crimping pieces 12*b*. The main body 21 includes front and rear flat portions 13F, 13R that are long along the transverse direction TD. A first engaging portion 22 couples the left ends of the flat portions 13F, 13R at the same side as the wire W. The main body 21 also has a second engaging portion 23 and a through hole 16 is formed between the engaging portions 22 and 23. The engaging portions 22, 23 are obtained by rotating the A-type engaging portions 14, 15 of the right single-face terminal fitting TRh by 180° about an axis substantially normal to the transverse direction TD. Thus, the terminal main bodies 11, 21 of the right and left single-face terminal fittings TRh, TLh are symmetrical with respect to the longitudinal axis arranged substantially normal to the transverse direction TD.

The right terminal fitting TR has a substantially square main body 24 with upper, intermediate and lower plates 24*a*, 24*b* and 24*c* arranged in this order from the top. The intermediate plate 24*b* is bent about a rear edge of the lower plate 24*c* and the upper plate 24*a* is bent about a front edge of the lower plate 24*c*. Through holes 16 are formed in the plates 24*a*, 24*b*, 24*c* and are aligned for receiving a bolt 16. A wire connecting portion 12 extends back from the main body 24 at a wire extending side. The wire connecting portion 12 has a bottom plate 12*a* that is continuous with the right end of the rear edge of the lower plate 24*c* and crimping pieces 12*b* extend up from the bottom plate 12. A wire W is connected with the wire connecting portion 12 and extends back from the main body 24.

The lower plate 24*c* has front and rear flat portions 13F, 13R. A first engaging portion 25 bridges the right ends of the flat portions 13F, 13R, and a second engaging portion 26 bridges the left ends of the flat portions 13F, 13R. The first engaging portion 25 of the lower plate 24*c* has substantially the same shape, construction, orientation and arrangement as the first engaging portion 14 of the right single-face terminal fitting TRh. Similarly, the second engaging portion 26 has substantially the same shape, construction, orientation and arrangement as the second engaging portion 15 of the right single-face terminal fitting TRh. Thus, the engaging portions 25, 26 of the lower plate portion 24*c* of the right terminal fitting TR are of A-type.

The upper plate 24*a* also has front and rear flat portions 13F, 13R. A first engaging portion 27 bridges the right ends of the flat portions 13F, 13R, and a second engaging portion 28 bridges the left ends of the flat portions 13F, 13R. The first and second engaging portions 27, 28 both are substantially flat, transversely spaced from each other and are located above the flat portions 13F, 13R by substantially the thickness of the flat portions 13F, 13R. A combination of the engaging portions 27, 28 is called a B-type for the sake of convenience. The lower surface of the first engaging portion 27 is embossed to project down at a left-end position to form a locking projection 29 that slopes up and to the left. The first engaging portion 27 has front and rear slits 30 that extend rightward from the left edge along the boundaries with the flat portions 13F, 13R. The slits 30 are on opposite sides of a left portion of the first engaging portion 27 where the locking projection 29 is formed. Thus, the left portion of the first engaging portion 27 is slightly resiliently deformable up and down along the arrangement direction AD. A locking hole 31 is formed at a right end of the second engaging portion 28, and a slanted surface 32 is formed on the lower surface of the second engaging portion 28 to extend from the left edge to the locking hole 31. The second engaging portion 28 has front and rear slits 30 that extend rightward from the left edge along the boundaries with the flat portions 13F, 13R.

The intermediate plate 24*b* has a through hole 16 substantially in its center, and has portions substantially corresponding to the flat portions 13F, 13R of the upper and lower plates 24*a*, 24*c*. Additionally, the intermediate plate 24*b* is shaped so as not bulge out from the outer peripheral edges of the upper and lower plates 24*a*, 24*c* and not to correspond to the slits 19, 30 of the respective engaging portions 25, 26, 27, 28.

The left terminal fitting TL has a substantially square main body 33 with upper, intermediate and lower plates 33*a*, 33*b*, 33*c* arranged in this order from the top. The main body 33 is formed by closely folding the intermediate plate 33*b* about the rear edge of the lower plate 33*c* and the lower plate 33*c* about the front edge of the upper plate 33*a*. Through holes 16 are formed in the respective plates 33*a*, 33*b*, 33*c* and are aligned for receiving a bolt. A wire connecting portion 12 has a bottom plate 12*a* that is continuous with the left end of the rear edge of the upper plate 33*a* and crimping pieces 12*b* extend up from the left and right edges of a bottom plate 12*a*. A wire W is connectable with the wire connecting portion 12 by crimping, bending or folding the crimping pieces 12*b*.

The upper plate 33*a* has front and rear flat portions 13F, 13R, a first engaging portion 34 bridging the left ends of the flat portions 13F, 13R, and a second engaging portion 35 bridging the right ends of the flat portions 13F, 13R. The first engaging portion 34 of the upper plate 33*a* has a shape obtained by rotating the first engaging portion 25 of the lower plate 24*c* of the right terminal fitting TR by 180° about an axis along forward and backward directions. Similarly, the second engaging portion 35 of the upper plate 33*a* has a shape obtained by rotating the second engaging portion 26 of the lower plate 24*c* of the right terminal fitting TR by 180° about an axis along forward and backward directions or about an axis substantially normal to the transverse direction TD. In other words, the engaging portions 34, 35 of the upper plate 33*a* of the left terminal fitting TL are of inverted A-type, and the engaging portions 34, 35 each are formed with front and rear slits 19 that extend laterally to the left from the right edge along the boundaries with the flat portions 13F, 13R.

The lower plate 33*c* has front and rear flat portions 13F, 13R, a first engaging portion 36 bridging the left ends of the flat portions 13F, 13R, and a second engaging portion 37 bridging the right ends of the flat portions 13F, 13R. The first engaging portion 36 of the lower plate 33*c* has a shape obtained by rotating the first engaging portion 27 of the upper plate 24*a* of the right terminal fitting TR by 180° about an axis along forward and backward directions or by an axis arranged substantially normal to the transverse direction TD. Similarly, the second engaging portion 37 of the lower plate 33*c* has a shape obtained by rotating the second engaging portion 28 of the upper plate portion 24*a* of the right terminal fitting TR by 180° about an axis that extends forward and backward substantially normal to the transverse direction TD. In other words, the engaging portions 36, 37 of the lower plate portion 33*c* of the left terminal fitting TL are of inverted B-type. Thus, the terminal main bodies 33, 24 of the left and right terminal fittings TL, TR are symmetrical with respect to the axis that extends forward and backward substantially normal to the transverse direction TD. With the left terminal fitting TL rotated by 180°, the wire connecting portion 12 and the wire W thereof are at the right side, similar to the right terminal fitting TR. However, the crimping pieces 12*b* of the wire connecting portion 12 extend down, converse to the wire connecting portion 12 of the right terminal fitting TR.

The intermediate plate 33*b* is formed with the through hole 16 substantially in its center, and has portions corresponding to the flat portions 13F, 13R of the upper and lower plates 33*a*, 33*c*. However, the intermediate plate is shaped so as not to bulge out from the outer peripheral edges of the upper and lower plates 33*a*, 33*c* and not to correspond to the slits 19, 30 of the respective engaging portions 34, 35, 36, 37.

The four terminal fittings TRh, TL, TR, TLh may be assembled in a desired order. In this embodiment, the right terminal fitting TR and the left terminal fitting TL are assembled and then the right and left single-face terminal fittings TRh, TLh are assembled.

Figure 12A:
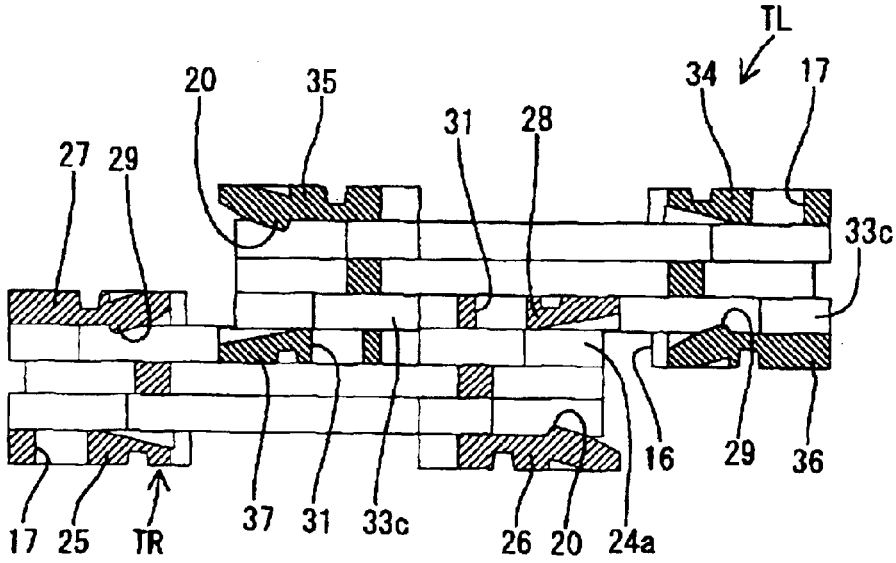
FIG. 12(*a*) and FIG. 12(*b*) are sections showing states while and after the left and right terminal fittings are assembled.
Figure 12B:
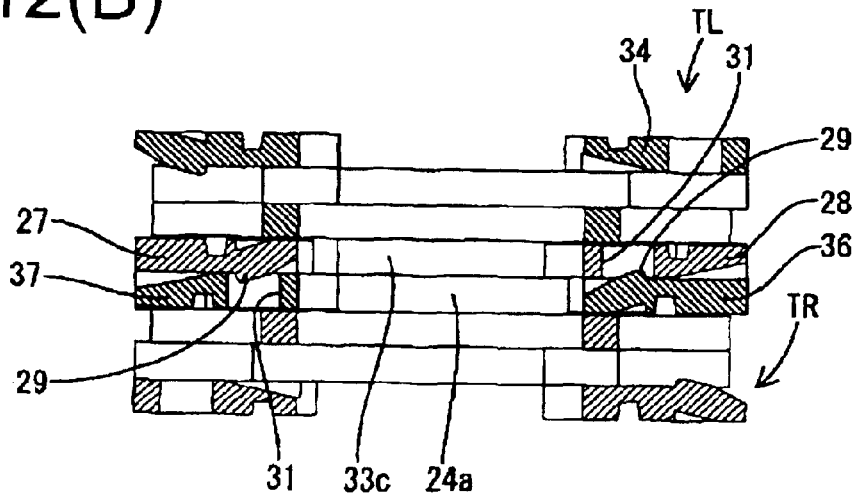

Assembly is achieved by positioning the first right terminal fitting TR to the right of and below the left terminal fitting TL, as shown in FIG. 1. Specifically, the right and left terminal fittings TR, TL are prepared to attain a positional relationship in which the wires W are substantially parallel to each other and most distant from each other. In this state, as shown in FIG. 12(*a*), the second engaging portion 28 of the upper plate 24*a* of the right terminal fitting TR is inserted into the through hole 16 of the lower plate 33*c* of the left terminal fitting TL and is positioned at the right side of the first engaging portion 36. Similarly, the first engaging portion 27 of the upper plate 24*a* of the right terminal fitting TR is positioned at the right side of the second engaging portion 37 of the lower plate portion 33*c* of the second terminal fitting TL. At this time, the left ends of the upper surfaces of the flat portions 13F, 13R of the upper plate 24*a* of the right terminal fitting TR are brought substantially into contact with the right ends of the lower surfaces of the flat portions 13f, 13R of the lower plate 33*c* of the left terminal fitting TL. Thus, the engaging portions 27, 28 of the right terminal fitting TR are above the engaging portions 36, 37 of the left terminal fitting TL substantially by the thickness thereof.

The right terminal fitting TR is slid to the left with respect to the left terminal fitting TL while the corresponding engaging portions 27, 28, 36, 37 of B-type are aligned. Thus, the first and second engaging portions 27, 28 of the right terminal fitting TR engage the second and first engaging portions 37, 36 of the left terminal fitting TL while sliding on the upper surfaces of the second and first engaging portions 37, 36. The terminal main bodies 24, 33 and the through holes 16 align along the arranging direction AD when the right and left terminal fittings TR, TL reach a properly connected state. Additionally, the locking projections 29 and the locking holes 31 engage to hold the two terminal fittings TL, TR together. In this state, the flat portions 13F, 13R and the engaging portions 27, 28, 36, 37 of the two terminal fittings TL, TR are alternately held in contact over one another. Thus, the terminal fittings TL, TR cannot disengage along the arranging direction AD. Further, the opposite front and rear ends of the engaging portions 27, 28, 36, 37 fit into the slits 30 of the mating engaging portions 37, 36, 28, 27. Consequently, large areas of engagement are achieved transversely for the engaging portions 27, 28, 36, 37. In the process of assembling the terminal fittings TL, TR, the wire connecting portions 12 and the wires W thereof are brought closer to each other as the terminal fittings TL, TR are slid. However, the wire connecting portions 12 and the wires W do not overlap.

The left terminal fitting TL and the right single-face terminal fitting TRh then are slid transversely and assembled. As a result, the first and second engaging portions 34, 35 of inverted A-type of the upper plate 33*a* of the left terminal fitting TL engage the second and first engaging portions 15, 24 of A-type of the left single-face terminal fitting TLh. The engagement of A-type is performed similar to the engagement of B-type. The locking projection 20 and the locking holes 17 engage when the two terminal fittings TRh, TL are assembled properly. Further, the wire connecting portions 12 and the wires W of the two terminal fittings TRh, TL gradually move closer together as the assembly progresses, but they do not overlap.

Finally, the right terminal fitting TR and the left single-face terminal fitting TLh are assembled by being slid transversely. These terminal fittings TR, TLh are assembled by the engagement of the engaging portions 25, 26 of A-type of the right terminal fitting TR and the engaging portions 22, 23 of inverted A-type of the left single-face terminal fitting TLh, and both wires W are brought closer to each other from most distant positions.

In this way, the four terminal fittings TRh, TL, TR, TLh are assembled one over another with their through holes 16 substantially aligned. Additionally, the wires W extending from the terminals TRh, TL, TR, TLh are arranged substantially in parallel to each other and without interfering with each other by being alternately placed at left and right positions in the respective layers.

As described above, the right terminal fitting TR and the left terminal fitting TL can be assembled by the engaging portions 27, 28, 36, 37 while being alternately placed. Thus, three or more wires W can be fixed to one fixed place. Further, the wires W are arranged substantially in parallel while being alternately placed at the left and right sides in the respective layers. Thus, for example, a spacing substantially corresponding to the thickness of the left terminal fitting TL is secured between the wires W connected with the right single-face terminal fitting TRh and the right terminal fitting TR. Therefore, the mutual interference of the wire connecting portions 12 and the wires W at the right side can be avoided.

The wire W of the right terminal fitting TR extends from a position near the right side. Additionally, the right terminal fitting TR is slid leftward during assembly with the left terminal fitting TL. Thus, the side of the right terminal fitting TR transversely opposite the wire W first reaches the left terminal fitting TL. Accordingly, the respective left and right wire connecting portions 12 and the wires W are at most distance positions at the start of the sliding movement, and are brought closer together as the sliding movement progresses. Therefore, the wire connecting portions 12 and wires W neither overlap nor interfere with each other during assembly.

The slits 30 of the right terminal fitting TR and the slits 19 of the left terminal fitting TL extend in transversely opposite directions. Thus, the engaging portions 27, 28, 36, 37 engage with sufficient areas of engagement during assembly of the left and right terminal fittings TL, TR. However, the slits of the same kind of terminal fittings, e.g. the slits 19, 30 of the right terminal fittings TR, extend in the same directions. Thus, a sufficient area of engagement does not exist, and the engaging portions cannot be engaged. Therefore, the same kinds of terminal fittings from which the wires W extend at the same side cannot be engaged in a manner to place the wires W directly over one another or to cause the wires W of the same kinds of terminal fittings to interfere with each other.

The engaging portions 25, 26, 27, 28, 34, 35, 36, 37 of the left and right terminal fittings TL, TR are formed to project from the front surfaces or the under surfaces of the flat portions 13F, 13R of the terminal main bodies 33, 24. Thus, the engaging portions 25 to 28, 34 to 37 could be deformed when the right terminal fitting TR or the left terminal fitting TL is held in contact with a fixing surface (not shown). However, the engaging portions 14, 15, 22, 23 project from only one of the front and under surfaces of the single-face terminal fittings TLh, TRh. Thus, the single-face terminal fittings TLh, TRh can be assembled one over another so that the flat surfaces of the terminal main bodies 11, 21 of the single-face terminal fittings TLh, TRh contact the fixing surface. As a result, interference of the engaging portions 25 to 28, 34 to 37 with the fixing surface is avoided, and the terminal fitting assembly (left terminal fitting TL and right terminal fitting TR) and the single-face terminal fittings TLh, TRh can be fixed stably to the fixing surface.

The terminal main bodies 24, 33 of the left and right terminal fittings TL, TR both are comprised of three plates 24*a*, 24*b*, 24*c*, 33*a*, 33*b*, 33*c* by folding one conductive metallic plate twice, and the engaging portions 25 to 28, 34 to 37 are formed on the plates 24*a*, 24*c*, 33*a*, 33*c* at the frontmost and undermost side of the plates. This means that the engaging portions 27, 28, 34, 35 at the front upper side and the engaging portions 25, 26, 36, 37 at the under side are formed respectively on the individual plates 24*a*, 24*c*, 33*a*, 33*c*. Therefore, a degree of freedom in designing the engaging portions is high.

Figure 13:
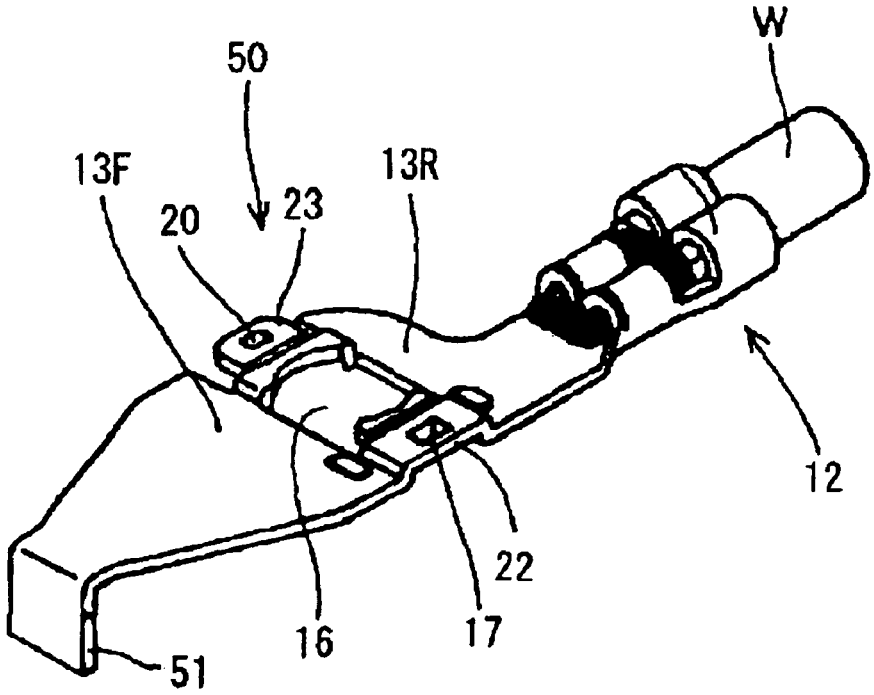
FIG. 13 is a perspective view of a terminal fitting according to a second embodiment of the invention.
Figure 14:
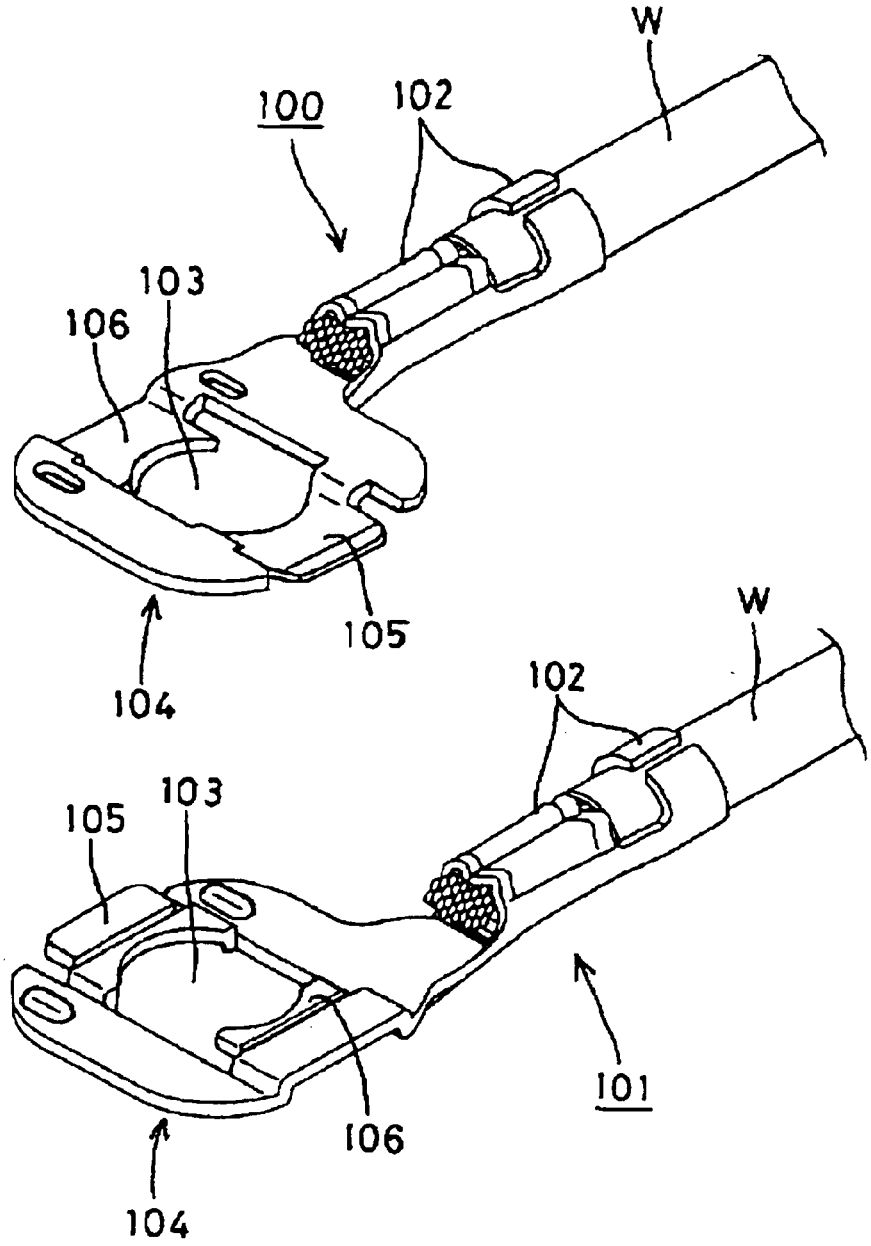
FIG. 14 PRIOR ART
FIG. 14 is a perspective view showing a state where terminal fittings of prior art are separated.
Figure 15:
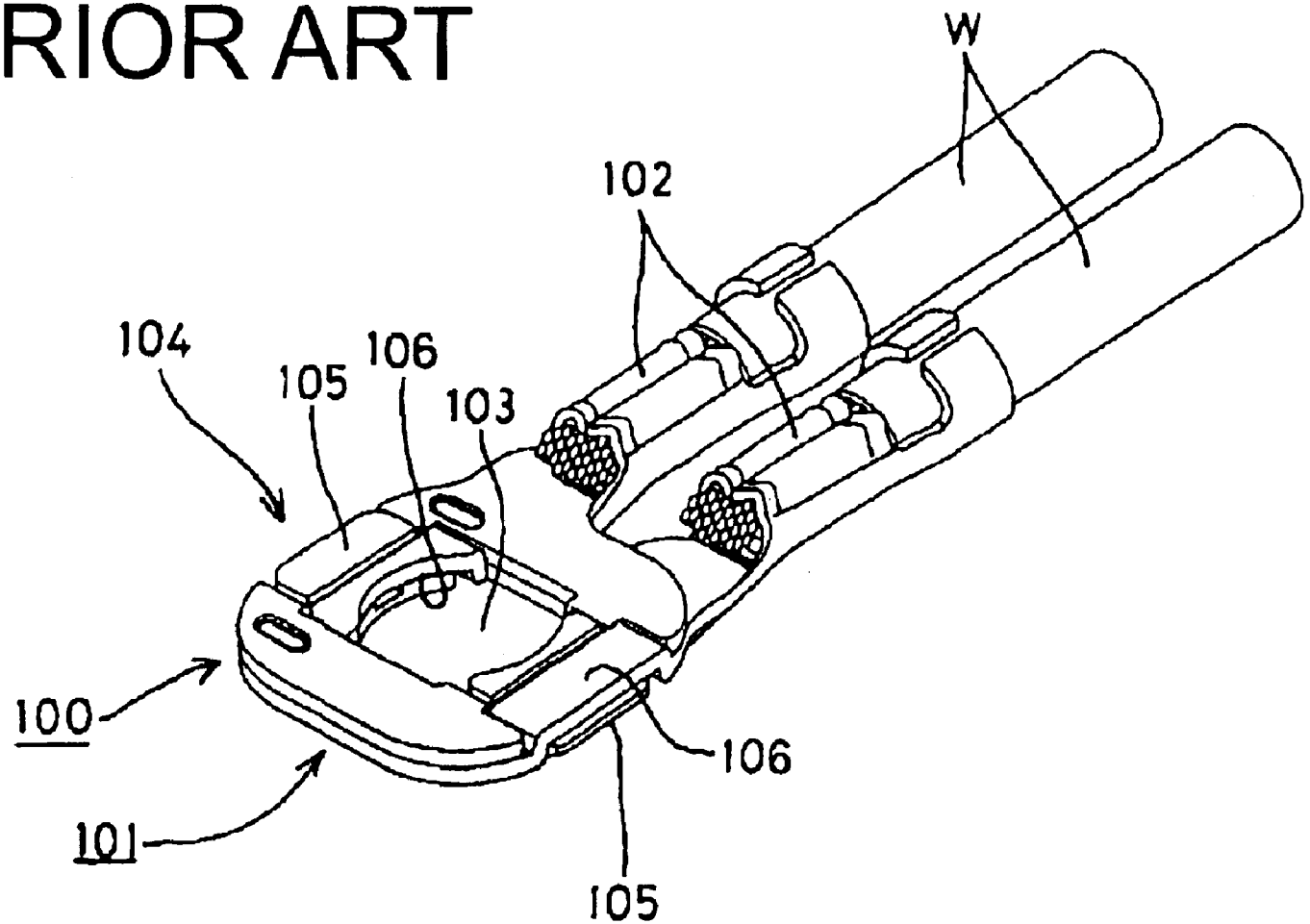
FIG. 15 PRIOR ART
FIG. 15 is a perspective view showing a state where the terminal fittings of prior art are assembled.

A single-face terminal fitting 50 with a turn-preventing portion 51 as shown in FIG. 13 may be used as the single-face terminal fitting to be fixed to the fixing surface. The turn-preventing portion 51 can fit in a groove (not shown) near the fixing surface to prevent the terminal fitting from being turned together when a bolt is screwed. Therefore, tightening of the bolt becomes easier.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The main body of each terminal fitting has three plates over in the foregoing embodiment. However, the main body may have two plates or four or more plates according to the invention. In the case of placing two plates, the plates at the front and under sides may be placed closely one over the other.

The main body of each terminal fitting is formed by folding one conductive metallic plate in the foregoing embodiment. However, one main body may be formed by placing a plurality of individual plates over one another.

The plate at the lower side of the main body of the right terminal fitting is substantially continuous with the wire connecting portion in the foregoing embodiment. However, the plate at the upper side may be continuous with the wire connecting portion according to the invention.

The plate at the front side of a plurality of plates of the main body of the left terminal fitting is continuous with the wire connecting portion in the foregoing embodiment. However, the plate at the under side may be continuous with the wire connecting portion according to the present invention.

One left terminal fitting and one right terminal fitting are assembled in the foregoing embodiment. However, the present invention is also applicable to cases where one left terminal fitting or one right terminal fitting is assembled or three or more left and right terminal fittings are assembled.

Two single-face terminal fittings are assembled in the foregoing embodiment. However, only one single-face terminal fitting may be assembled or no single-face terminal fitting may be assembled according to the invention.

Engaging means project from the upper and lower surfaces of the main body in the foregoing embodiment. However, either one of the engaging means on the upper or lower surfaces may not project from the main body.

What is claimed is:

1. A combined terminal fitting assembly comprising: a first terminal fitting with a wire connecting portion for enabling a wire to extend from a first-side position of a main body, a second terminal fitting with a wire connecting portion for enabling a wire to extend from a second-side position of a main body, the first and second terminal fittings being assembled such that the main bodies are substantially one over the other and the wires are substantially parallel at lateral sides, and engaging means at opposed surfaces of the main bodies for engaging each other by sliding the first terminal fitting substantially along a transverse direction with respect to the second terminal fitting and for holding the second and first terminal fittings assembled, at least one single-face terminal fitting with a substantially flat main body and opposite upper and lower surfaces, a wire extending from the flat main body at a position displaced along the transverse direction and the main body having an engaging means projecting from only one of the upper and lower surfaces of the main body.

2. The combined terminal fitting assembly of claim 1, wherein the single-face terminal fitting is assembled with at least one of the terminal fittings located at the opposite ends of a group of terminal fittings placed substantially one over another with the engaging means thereof faced toward the group of the terminal fittings.

3. A combined terminal fitting assembly comprising: a first terminal fitting with a wire connecting portion for enabling a wire to extend from a first-side position of a main body, a second terminal fitting with a wire connecting portion for enabling a wire to extend from a second-side position of a main body, the first and second terminal fittings being assembled such that the main bodies are substantially one over the other and the wires are substantially parallel at lateral sides, and engaging means at opposed surfaces of the main bodies for engaging each other by sliding the first terminal fitting substantially along a transverse direction with respect to the second terminal fitting and for holding the second and first terminal fittings assembled, wherein each main body comprises a plurality of plates folded from one conductive plate material, and the engaging means are formed on the plates at upper and lower positions.

4. A combined terminal fitting assembly comprising:

a first terminal fitting (TL) having opposite upper and lower surfaces and engaging portions (34, 35; 36, 37) projecting from each of the upper and lower surfaces, a first wire connecting portion (12) for enabling a wire (W) to extend from the first terminal fitting;

a second terminal fitting having opposite upper and lower surfaces and engaging portions projecting from each of the upper and lower surfaces, the engaging portions projecting the upper surface of the second terminal fitting engaging the engaging portions projecting from the lower surface of the first terminal fitting for assembling the first and second terminal fittings substantially one over the other, a second wire connecting portion for enabling a wire to extend from the second terminal fitting substantially parallel to and offset from the wire from the first terminal fitting; and a third terminal fitting having opposite upper and lower surfaces, engaging portions projecting from only the upper surface of the third terminal fitting and engaging the engaging portions projecting from the lower surface of the second terminal fitting for assembling the second and third terminal fittings, a third wire connecting portion for enabling a wire to extend from the third terminal fitting substantially parallel to and offset from the wires of the first and second terminal fittings.

5. The combined terminal filling of claim 4, wherein each of the first, second and third terminal fittings has opposite left and right sides, the wire connecting portions of the first and third terminal fittings being closer to the left sides than to the right sides thereof.

6. The combined terminal fitting of claim 5, wherein the wire connecting portion of the second terminal fitting is closer to the right side thereof.

7. The combined terminal fitting of claim 4, wherein the lower surface of the third terminal fitting is substantially flat.

8. The combined terminal fitting of claim 7, further comprising a fourth terminal fitting having opposite upper and lower surfaces, engaging portions projecting from only the lower surface of the fourth terminal fitting and engaging the engaging portions at the upper surface of the first terminal fitting for assembling the first and fourth terminal fittings, a fourth wire connecting portion displaced from the first wire connecting portion for enabling a wire to extend from the fourth terminal fitting substantially parallel to and offset from the wires of the first, second and third terminal fittings.

9. The combined terminal fitting of claim 8, wherein the upper surface of the fourth terminal fitting is substantially flat.

* * * * *